United States Patent [19]

Nau

[11] Patent Number: 4,516,771

[45] Date of Patent: May 14, 1985

[54] BATTING AID

[76] Inventor: Alan J. Nau, 14640 Tulane St., Brookfield, Wis. 53005

[21] Appl. No.: 452,740

[22] Filed: Dec. 23, 1982

[51] Int. Cl.[3] ..... A63B 69/40

[52] U.S. Cl. ..... 273/26 R

[58] Field of Search ..... 273/26 R, 29 A, 35, 273/183 E, 184 R, 191 R; 211/18, 24, 32, 123, 171

[56] References Cited

U.S. PATENT DOCUMENTS

| | | | |
|---|---|---|---|
| 1,832,730 | 11/1931 | Pack | 211/171 |
| 2,443,131 | 6/1948 | Fessler | 273/26 R |
| 3,039,770 | 6/1962 | Ferretti | 273/26 R |
| 3,527,354 | 9/1970 | Sokolow | 211/171 |
| 3,904,199 | 9/1975 | Burchette | 273/26 R |
| 3,940,131 | 2/1976 | Claire, Jr. | 273/26 R |
| 3,941,250 | 3/1976 | Ott | 211/171 |
| 4,093,217 | 6/1978 | Piccini | 273/26 R |

*Primary Examiner*—Richard C. Pinkham
*Assistant Examiner*—T. Brown
*Attorney, Agent, or Firm*—Andrus, Sceales, Starke & Sawall

[57] ABSTRACT

A batting practice device for aiding a batsman to perfect a level swing includes a pair of elongated, vertically spaced, inclined tubular arms resiliently mounted at their inner ends on a mounting plate. The arms provide an unobstructed substantially horizontal target area for passage of a bat therebetween during a practice swing. An adjustment assembly is also provided for raising and lowering the mounting plate to vary the height of the arms relative to the strike zone.

7 Claims, 4 Drawing Figures

BATTING AID

U.S. PRIOR ART OF INTEREST

BATTING AID
U.S. Prior Art of Interest

| U.S. Pat. No. | Patentee | Date |
|---|---|---|
| 2,443,131 | Fessler | 6-8-48 |
| 3,117,451 | Ray et al | 1-14-64 |
| 3,386,733 | Russo et al | 6-4-68 |
| 3,475,026 | Cooper | 10-28-69 |
| 3,921,976 | Lane | 11-25-75 |
| 3,937,464 | Zalewski | 2-10-76 |
| 3,940,131 | St. Claire, Jr. | 2-24-76 |

BACKGROUND OF THE INVENTION

The present invention relates to athletic training devices, and more particularly to a batting practice device which aids a batsman to perfect a level swing.

It is well known in the sport of baseball that good hitters have level swings to provide maximum power when hitting a ball. It is therefore desirable to provide a training device which allows a batsman to practice and perfect a level swing in all areas of the strike zone.

Various training devices have been developed in the past for assisting a baseball player in practicing his swing. For example, in U.S. Pat. Nos. 3,940,131, 3,937,464 and 3,475,026, training devices are shown which provide vertically spaced horizontally extending arms which may be raised or lowered to various positions. None of the arms of these devices, however, are resiliently mounted and therefore damage to the arms or the bat may occur if the batsman misses the target area. U.S. Pat. No. 3,386,733 shows a batting practice device having resiliently mounted members for assisting a batsman in developing a level swing. This device, however, is relatively cumbersome and is not easily transportable by young ballplayers. In another type of training device, a batsman strikes a target located between a pair of vertically spaced arms, as shown in U.S. Pat. No. 2,443,131. This latter device however, does not simulate an actual batsman's swing since there is no follow-through. U.S. Pat. No. 3,921,976 shows a hand held batting aid device which, although giving the batter a realistic feel in hitting a ball, has no means for insuring that the batter's swing is level. Finally, U.S. Pat. No. 3,117,451 shows an apparatus for analyzing a batter's swing to indicate bat speed, plane of bat swing, and point of ball impact during the swing. Such an apparatus, however, is relatively expensive and is thus not practical for home use or daily practice sessions at playgrounds or parks.

SUMMARY OF THE INVENTION

A batting practice device which aids a batsman to perfect a level swing. The device includes a mounting plate, a pair of elongated members resiliently mounted at their inner ends on the plate and projecting outwardly therefrom, and means for releasably securing the plate to a supporting structure. The elongated members are vertically spaced from one another and extend substantially horizontally from the mounting plate to form an unobstructed substantially horizontal target area for passage of a bat therebetween during a practice swing.

The resilient mounting of the arms enables the arms to yield with respect to the mounting plate if accidentally struck by a bat. The elongated arms are tubular in shape and are comprised of a resilient plastic material so as not to be permanently deformed upon being accidentally struck by a bat and so as not to damage the surface of the bat. The arms also include indicia means to provide assistance to a batter in aligning the hitting portion of the bat within the horizontal area between the arms.

The means for releasably securing the mounting plate and arms to a supporting structure includes an adjustment assembly for raising and lowering the mounting plate. This adjustment assembly enables a player to practice a level swing in all areas of the strike zone.

The present invention thus provides an improved portable batting practice device which is simple in construction and easy to use.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
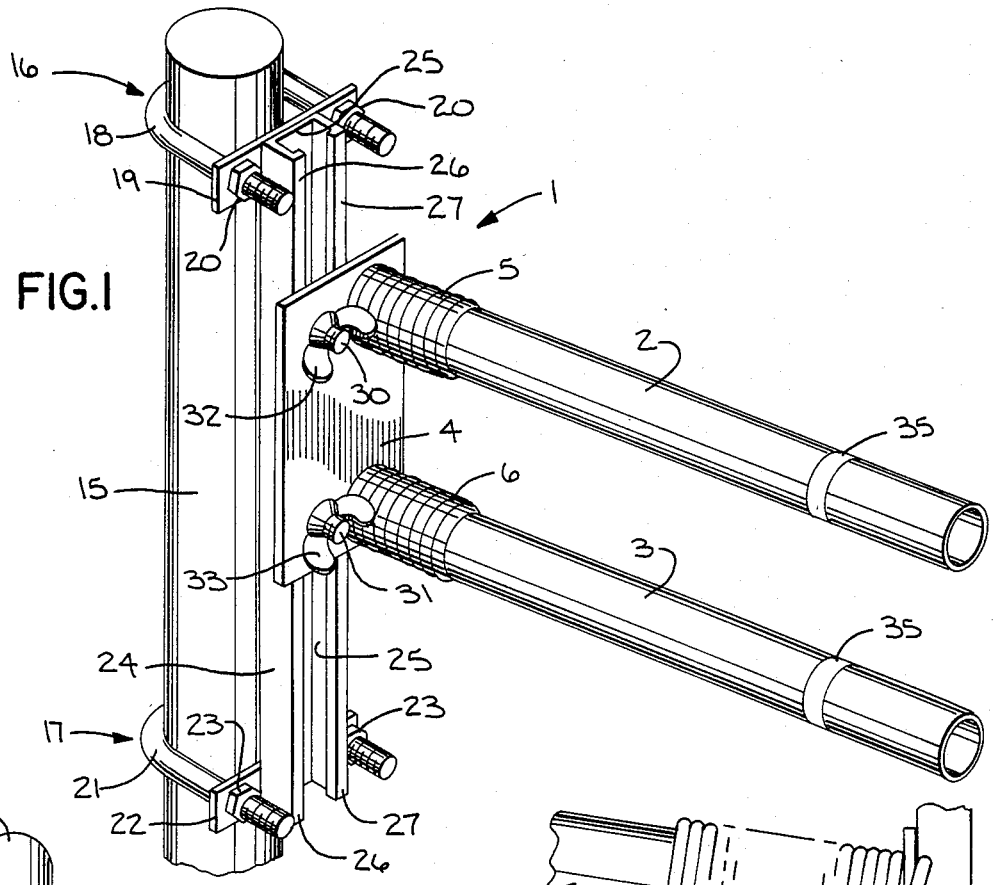
FIG. 1 is a perspective view of the batting practice device of the present invention.

Referring now to the drawings, FIG. 1 shows a batting aid device generally designated by numeral 1, constructed in accordance with the principles of the present invention. The batting aid device 1 includes a pair of elongated, vertically spaced, horizontally extending arms 2 and 3. The arms 2 and 3 extend parallel to one another to form an unobstructed, substantially horizontal target area for the passage of a bat therebetween during a practice swing. The vertical spacing between upper arm 2 and lower arm 3 is somewhat greater than the width of the outer portion of a conventional baseball bat. The arms 2 and 3 are tubular in shape and are comprised of a relatively thin resilient plastic material so as not to be permanently deformed upon being accidentally struck by a bat. The arms 2 and 3 include indicia means in the form of tape 35 wrapped around the outer ends thereof. The tape 35 provides assistance to a batter in aligning the outer hitting portion of a bat within the target area.

Figure 2:
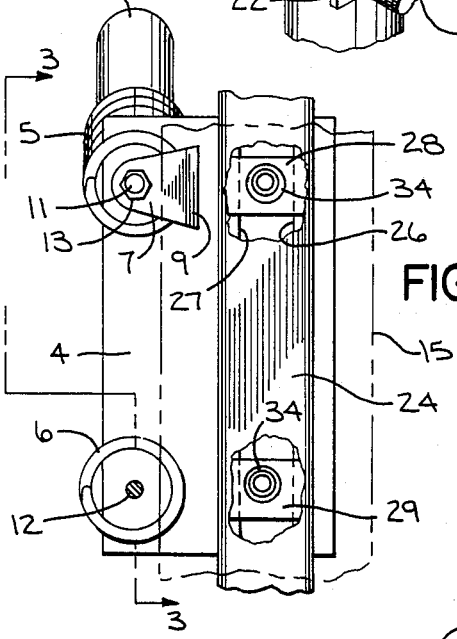
FIG. 2 is a fragmentary rear view in elevation of the device of FIG. 1.
Figure 3:
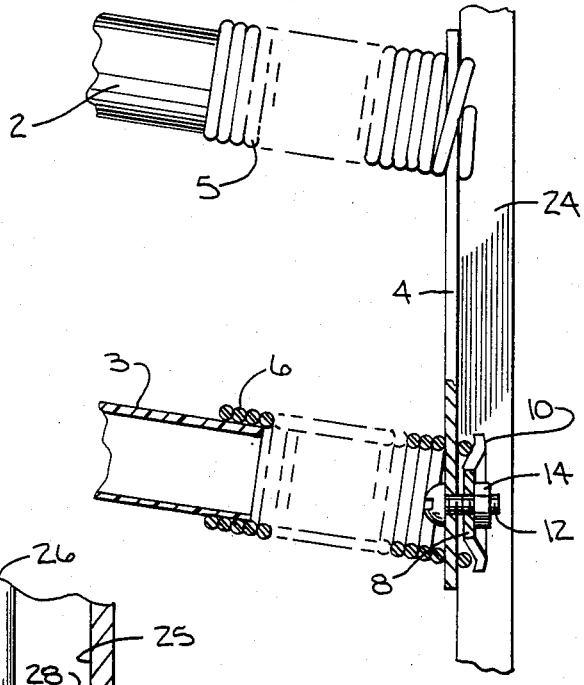
FIG. 3 is a fragmentary side view in elevation and partially in section taken along the plane of the line 3—3 in FIG. 2.

The inner ends of arms 2 and 3 are resiliently mounted on a mounting plate 4. As seen best in FIG. 3, arms 2 and 3 project outwardly from plate 4 at a slight upward inclination of about 5° to 10° from the horizontal. The resilient mounting for arms 2 and 3 includes a pair of coil springs 5 and 6, respectively. The springs 5 and 6 have an inner diameter substantially identical to the outer diameter of arms 2 and 3 for receiving the inner ends of arms 2 and 3 in a press fit arrangement. The inner ends of springs 5 and 6 are attached to plate 4 by passing its innermost coil around the side edge of plate 4, as shown best in FIGS. 2 and 3, so that this coil is on the back side of plate 4, while the remaining coils project from the front side of plate 4. The springs 5 and 6 are then affixed to plate 4 by means of a pair of clamp plates 7 and 8, respectively. Each plate 7 and 8 includes a rim 9 and 10, respectively, the inner surface of which engages the innermost coil of springs 5 and 6, as shown best in FIG. 3. Bolts 11 and 12 pass through openings in plate 4 and in plates 7 and 8, respectively, so that when nuts 13 and 14 are turned down thereon the clamping plates 7 and 8 engage the innermost coil of springs 5 and 6 and securely hold them in place.

The arms 2 and 3 are supported in their generally horizontal position by a vertically extending support member, such as post 15. The arms 2 and 3 and plate 4 are releasably secured to post 15 by means of a pair of U-clamps 16 and 17. Upper clamp 16 includes a U-shaped rod 18, the legs of which pass through a clamping bar 19. The ends of rod 18 threadedly engage a pair of nuts 20, so that when the nuts 20 are turned down upon the legs of rod 18, the clamping bar 19 firmly engages post 15. The lower clamp 17 is identical to upper clamp 16 and also includes a U-shaped rod 21, clamping bar 22 and nuts 23.

Figure 4:
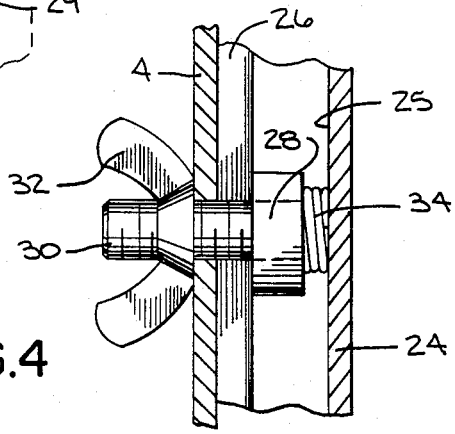
FIG. 4 is a fragmentary detailed view in cross section showing the manner of locking the arms at a desired vertical height.

As a means for aiding a batsman to perfect a level swing at various heights in the strike zone, the batting aid device 1 includes a means for adjusting the arms 2 and 3 and plate 4 vertically with respect to post 15 and securing clamps 16 and 17. The adjustment means includes a bracket 24 having a channel 25 formed therein running along its length. Bracket 24 is a relatively narrow elongate member extending between clamping bars 19 and 22 and welded thereto. As shown best in FIG. 1, channel 25 also extends between clamping bars 19 and 22 so that its longitudinal axis is substantially perpendicular to the ground. Bracket 24 includes a pair of opposite inwardly directed flanges 26 and 27 which provide channel 25 with a generally T-shaped configuration. The inner surfaces of flanges 26 and 27 provide a pair of bearing surfaces which overlap the edges of a pair of key members 28 and 29 slidably received within channel 25. As shown best in FIG. 2, key members 28 and 29 are vertically spaced from one another and are slidably received within channel 25. Key members 28 and 29 include threaded shank portions 30 and 31, respectively, which project therefrom and extend through a pair of openings in mounting plate 4 to project from the front surface thereof. As a means for locking the plate 4 in the desired vertical position on bracket 24, there is provided a pair of wing nuts 32 and 33 threadedly engaged on shank portions 30, 31 respectively. As shown best in FIG. 4, when wing nuts 32 and 33 are turned down on shank portions 30 and 31, key members 28 and 29 are firmly engaged against the bearing surfaces of flanges 26 and 27 of bracket 24 to prevent sliding movement of plate 4 within channel 25. A spring 34 is disposed between the web portion of bracket 24 in channel 25 and each key member 28 and 29, as shown best in FIG. 4. The coil spring 34 biases the key members 28, 29 to the left, as seen in FIG. 4, and provides friction with bracket 24 so that when wing nuts 32 and 33 are loosened the mounting plate 4 and arms 2 and 3 do not readily fall by gravity to the lower end of bracket 24.

In operation, a batsman first places the U-shaped clamps 15 and 17 over the top of post 15 and turns down nuts 20 and 23 to secure the device in a stationary position. Wing nuts 32 and 33 are then loosened so that the vertical position of arms 2 and 3 may be adjusted by raising and lowering mounting plate 4 on bracket 24. After proper vertical adjustment, the batter stands in a batting position as if he was going to hit a pitched ball and swings the bat. If the swing is level, the bat will properly pass between the arms 2 and 3. If the swing is not level, it will hit one or both of arms 2 and 3. The arms 2 and 3 will merely deflect upon being struck by the bat due to the resilient mounting of springs 5 and 6 and then return immediately to their original position without damaging either the arms 2 or 3 or the bat. By constantly practicing in this manner, a batter will learn to swing level at balls in any portion of the strike zone.

A batting device has been shown and described which is useful in aiding a batsman to perfect a level swing. While the invention has been herein shown and described in its preferred embodiment, many modifications may be made thereto within the scope of the invention. For example, various types of clamp means may be utilized to releasably secure arms 2 and 3 to supporting post 15. In addition, the distance between arms 2 and 3 may be altered depending upon the desired skill level to be obtained, and the length of each arm 2 and 3 may also be varied. Further, arms 2 and 3 may be mounted to extend on either side of post 15 allowing for use by either a right handed or left handed batter.

Various modes of carrying out the invention are contemplated as being within the scope of the following claims particularly pointing out and distinctly claiming the subject matter which is regarded as the invention.

I claim:

1. A batting practice device, comprising:

a mounting plate;

a pair of elongated arms resiliently mounted at their inner ends on said plate and projecting outwardly therefrom, said resilient mounting includes spring means between the inner end of each of said elongated arms and said mounting plate, said elongated arms being spaced apart and parallel to one another and disposed at an upward inclination from said mounting plate to form an unobstructed target area for passage of a bat therebetween during a practice swing; and means for releasably securing said plate to a supporting structure.

2. The batting practice device of claim 1, wherein said spring means if a coil spring affixed at one end to said mounting plate and having an inner diameter substantially identical to the outer diameter of said elongated arm for receiving the inner end of said elongated arm in a press fit arrangement.

3. The batting practice device of claim 1, wherein said elongated arms are tubular in shape and are comprised of a resilient plastic material so as not to be permanently deformed upon being accidentally struck by a bat.

4. The batting device of claim 1, further including indicia means on said elongated arms to provide assistance to a batter in aligning the hitting portion of a bat within the target area.

5. A batting practice device, comprising:

a mounting plate;

a pair of elongated arms resiliently mounted at their inner ends on said plate and projecting outwardly therefrom, said elongated arms being spaced apart and parallel to one another and disposed at an upward inclination from said mounting plate to form an unobstructed target area for passage of a bat therebetween during a practice swing; and mean for releasably securing said plate to a supporting structure, said securing means includes an adjustment means for raising and lowering said mounting plate on said securing means, and said adjustment means includes a bracket member having a channel formed therein running along its length, said channel having a longitudinal axis substantially perpendicular to the ground, a key member associated with said mounting plate and slidably received within said channel, and means cooperating with said key member for locking said plate in the desired position on said bracket member.

6. The batting practice device of claim 5, wherein said bracket member includes a pair of opposite inwardly directed flanges forming a T-shaped channel, said flanges overlapping the edges of said key member to provide a sliding bearing surface therefor.

7. The batting practice device of claim 6, wherein said key member includes a threaded shank portion projecting from said channel, said mounting plate includes a hole for receiving said shank portion, and said locking means includes a wing nut threadedly engaged on said shank portion so that when turned down thereon said plate is secured to said bracket member.

* * * * *